United States Patent [19]

Straub et al.

[11] Patent Number: 4,899,927

[45] Date of Patent: Feb. 13, 1990

[54] COLLAPSIBLE CONTAINER

[75] Inventors: Gustave O. Straub, Milwaukee; Charles W. Kurth, Cedarburg, both of Wis.

[73] Assignee: Container Corporation of America, Clayton, Mo.

[21] Appl. No.: 315,125

[22] Filed: Feb. 24, 1989

[51] Int. Cl.[4] ..... B65D 5/10

[52] U.S. Cl. ..... 229/109; 229/120.17; 229/157; 229/185

[58] Field of Search ..... 229/41 C, 109, 120.17, 229/157, 185

[56] References Cited

U.S. PATENT DOCUMENTS

| | | | |
|---|---|---|---|
| 3,226,007 | 12/1965 | Thies et al. | 229/185 |
| 4,119,266 | 10/1978 | Dempster | 229/109 |
| 4,148,427 | 4/1979 | Baker | 229/120.17 |
| 4,343,429 | 8/1982 | Cherry | 229/109 |
| 4,386,729 | 6/1983 | Schmidt | 229/109 |
| 4,392,607 | 7/1983 | Perkins, Jr. | 229/109 |
| 4,502,624 | 3/1985 | Burrell | 229/109 |
| 4,511,080 | 4/1985 | Madsen et al. | 229/157 |
| 4,582,198 | 4/1986 | Ditton | 229/185 |

*Primary Examiner*—Gary Elkins
*Attorney, Agent, or Firm*—Richard W. Carpenter

[57] ABSTRACT

A container having a body formed from a plurality of side panels foldably joined to each other to form a tubular structure with bottom closure flaps foldably joined to the lower edges of certain of the side panels and arranged in overlapping interlocked relation, and wherein certain of the bottom closure, flaps have slots therein for receiving lower portions of certain of the side panels to help the container maintain its original shape.

12 Claims, 2 Drawing Sheets

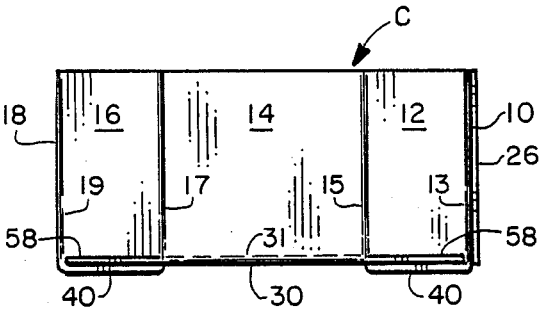
FIG. 4
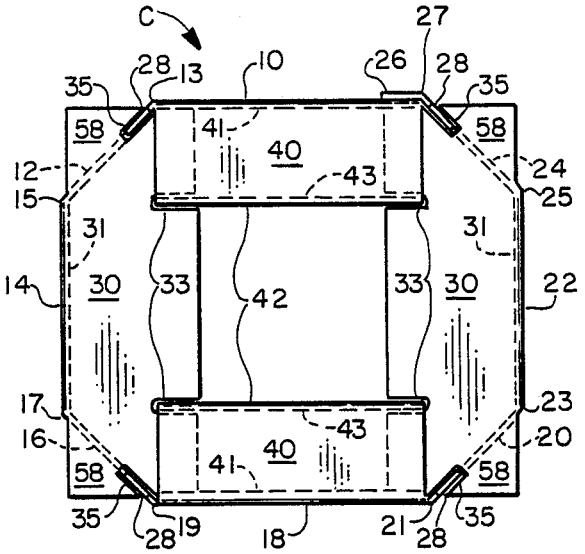
FIG. 5
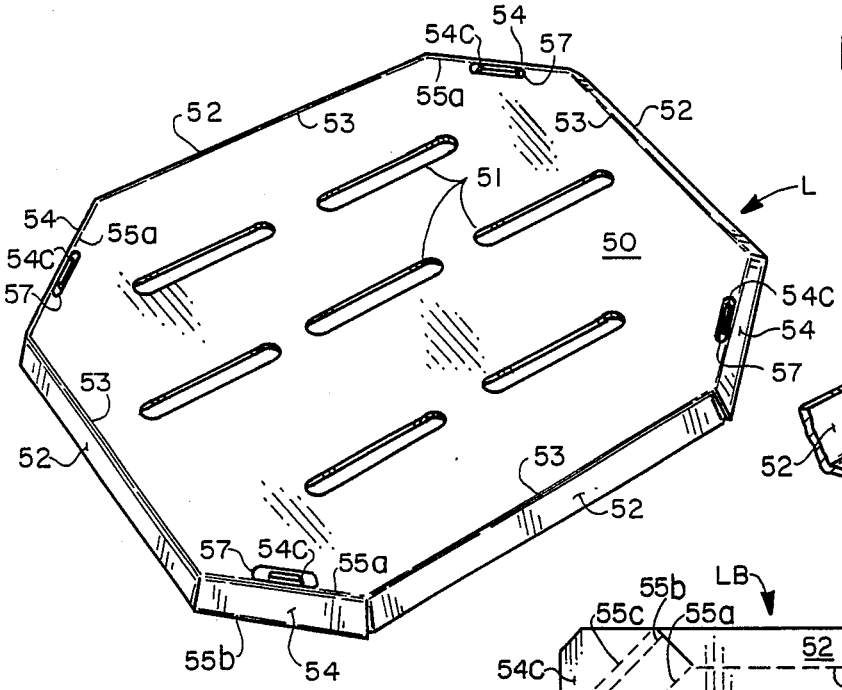
FIG. 6
FIG. 7
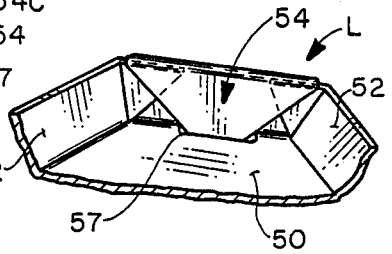
FIG. 8
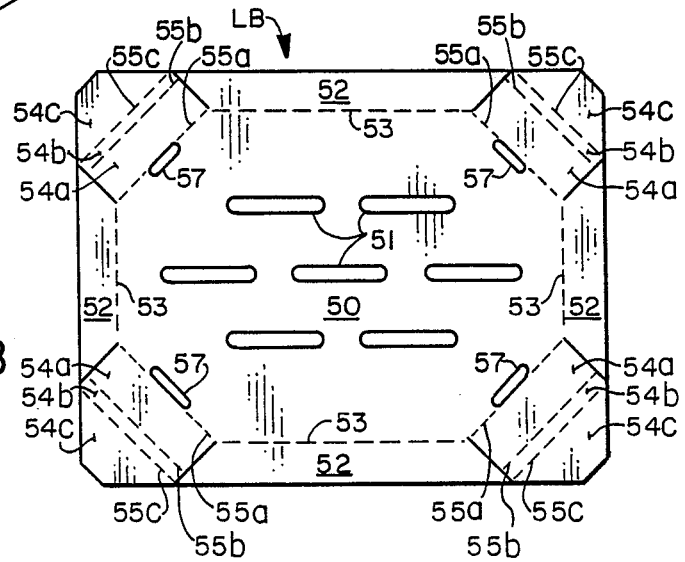

COLLAPSIBLE CONTAINER

BACKGROUND OF THE INVENTION

1. Field of the Invention

This invention relates to collapsible, paperboard shipping containers, and more particularly to an improveds octagonal shaped, container adapted to retain its original shape when filled with a relatively heavy article.

2. Description of Background Art

The present invention constitutes an improvement over the structure disclosed in U.S. Pat. No. 4,441,649, which patent represents the most pertinent of the background art of which the applicant is aware.

Neither Pat. No. 4,441,649, nor any other prior art patent of which Applicant is aware, discloses a container having an octagonal, tubular body with bottom closure flaps foldably joined to the lower edges of certain of the body side panels and arranged in overlapped, interlocking relation, wherein certain of the bottom closure flaps have slots therein for receiving lower portions of certain of the side panels to help the container maintain its original shape when it is filled with a relatively heavy product.

SUMMARY OF THE INVENTION

It is an object of the present invention to provide an improved, rugged, collapsible shipping container suitable for the packaging of a relatively heavy and/or bulky article article such as a watermelon.

A more specific object of the invention is the provision of a collapsible, octagonal shaped, paperboard shipping container including means to maintain its shape when filled with a product.

Yet another specific object of the invention is the provision of a collapsible, paperboard, shipping container having a tubular body and closure flaps at the lower end of the body, certain of which have slots for receiving portions of certain of the side panels of the container to help the container maintain its original shape.

These and other objects of the invention will be apparent from an examination of the following description and drawings.

BRIEF DESCRIPTION OF THE DRAWINGS

FIG. 4 is a fragmentary side elevational view of a lower portion of the container illustrated in the other views;

FIG. 5 is a bottom plan view of the container illustrated in FIG. 1;

FIG. 6 is a fragmentary perspective view of a lid of the type suitable for use with the container illustrated in the other views, as seen from above;

FIG. 7 is a fragmentary perspective view of a portion of the lid illustrated in FIG. 6, as seen from below; and FIG. 8 is a plan view of a blank of paperboard from which the lid illustrated in the previous views may be formed.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
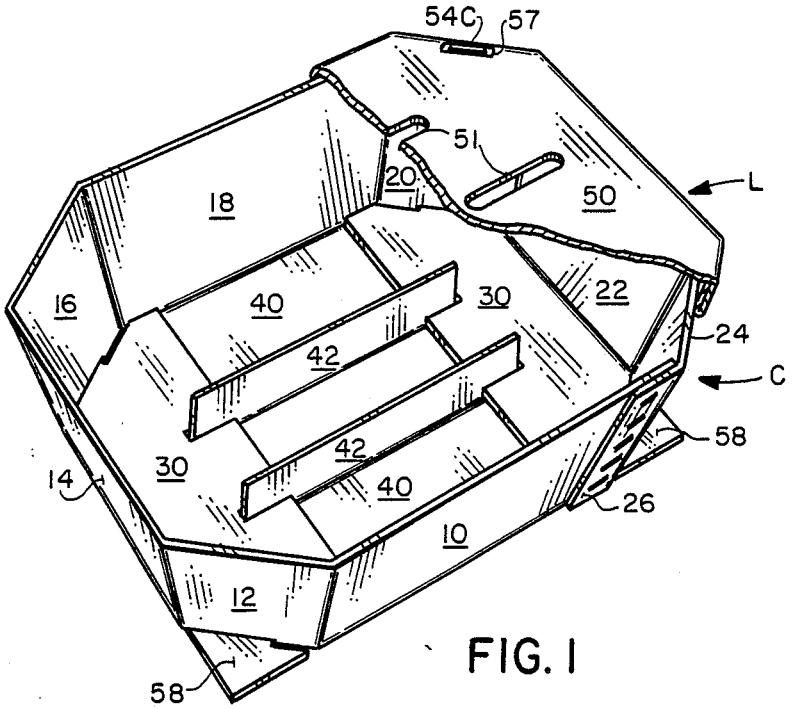
FIG. 1 is a fragmentary perspective view, as seen from above, of a shipping container and lid embodyiny features if the present invention, with portions of the lid structure broken away.
Figure 2:
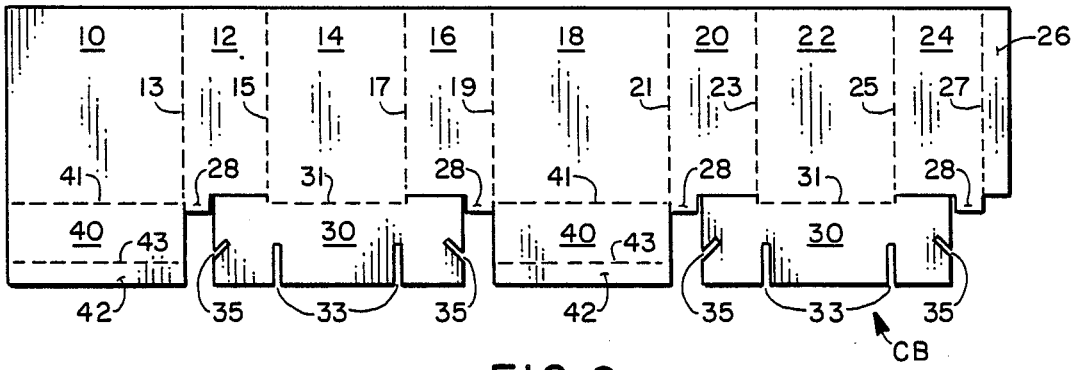
FIG. 2 is a plan view of a blank of foldable paperboard from which the container illustrated in the other views may be formed.
Figure 3:
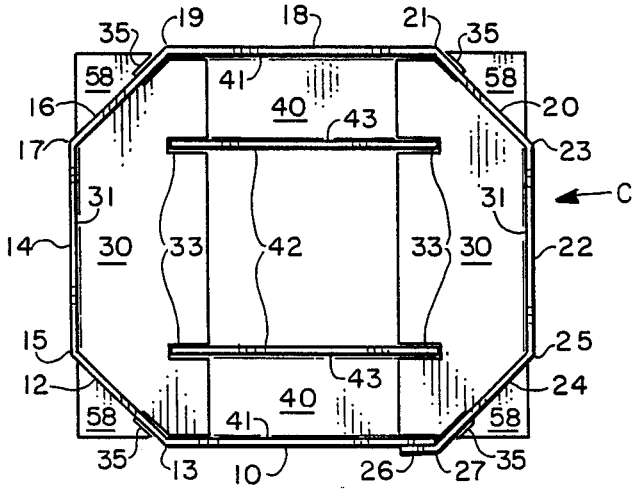
FIG. 3 is a top plan view of the container illustrated in FIG. 1, with the lid removed.

Referring now to the drawings for a better understanding of the invention, it will be seen that the invention includes a collapsible shipping container C illustrated in FIG. 1, which may be formed from a unitary blank CB of foldable paperboard illustrated in FIG. 2, and a lid L, which may be formed from the unitary blank LB of paperboard illustrated in FIG. 8.

As best seen in FIG. 2, the container blank CB includes the following: first side panel 10, second side panel 12, third side panel 14, fourth side panel 16, fifth side panel 18, sixth side panel 20, seventh side panel 22, eighth side panel 24, and connecting panel 26, which panels are foldably joined to each other along fold lines 13, 15, 17, 19, 21, 23, 25, and 27.

The container is in the form of a tubular structure that is preferably octagonal in cross-section and open at the upper and lower ends. The upper end of the container C can be closed by a separate lid L, as described later in the specification.

The lower end of the structure is at least partly closed by pairs of inner and outer bottom closure flaps 30 and 40, respectively. Inner closure flaps 30 are foldably joined along fold lines 31 to the lower edges of third and seventh side panels 14 and 22, respectively. It should be noted that each inner closure flap 30 has a width approximately equal to the combined widths of the side panel to which it is attached and the two adjacent panels.

Each inner closure flap 30 has extending thereinto from the from the outer edge thereof a pair of slots 33 that are parallel to and spaced from each other and adapted to receive portions of outer closure flap lock tabs 42 as hereinafter described.

Also, each inner closure flaps 30 has extending diagonally thereinto from opposite side edges thereof a pair of slots 35 adapted to receive lowers portions of adjacent side panels when the container is erected.

As best seen in FIG. 2, each of the side panels 12, 16, 20 and 24 has a projection 28 extending downwardly from its lower edge. These projections are the portions of the side panels adapted to be received within the slots 35 of the inner closure flaps when the container is erected.

A pair of outer closure flaps 40 are foldably joined along fold lines 41 to the lower edges of first and fifth side panels 10 and 18, respectively, and each outer closure flap 40 has a tuck or lock flap 42 foldably joined along fold line 43 to its inboard edge.

When the container is manufactured, connecting panel 26 at one end of the blank may be attached the side edge of first side wall panel 10, in any desired manner such as by glue or staples. The present invention has been shown with staples, because they provide a stronger manufacturer's joint for a container used to package a relatively heavy article. After it has been formed the container can be shipped in a collapsed condition to the packer.

If desired the container may be made from a pair of blanks (not shown) each of which are equal to one half of the blank CB, except that each blank would have a separate connecting panel at one end thereof, with each connecting panel being attached to a side panel of the other blank.

To erect the container from the collapsed blank, the blank is opened to form a tubular structure that is octagonal in shape. It will be seen that first and fifth side panels 10 and 18, respectively, are parallel to each other and extend normal to third and seventh side wall panels 14 and 22, respectively, with the remaining side panels 12, 16, 20, and 24 extending diagonally therebetween.

After the container has been formed into an octagonal shape, the inner closure flaps 30 are folded inboardly at right angles to the side panels to which they are attached, and the projections 28 are inserted into the slots 35 of the inner closure panels to lock the diagonal side walls in position. This maintains the entire container body in its proper shape and minimizes the deflection of the side panels out of proper position when the container is filled.

Then the outer closure flaps 40 are folded inboardly at right angles to the panels to which they are attached. Portions of the outer closure flaps 40 will overlap portions of the inner closure flaps 30. The tuck or lock tabs 42 are then inserted into the slots 33 of the inner closure flaps 30.

This arrangement not only locks the bottom flaps of the container to each other to form a rigid structure, but also, as best seen in FIG. 1, the lock or tuck tabs 42 extend upwardly into the container where they can serve to cradle or cushion an article packaged in the container.

It should be also noted that the inner closure flaps 30 each have corner portions 58 which extend outboardly beyond the related diagonally extending side panels. The purpose of this is to afford even greater stability for the container and to permit the container, along with other containers to be secured, to a pallet by stapling the container to the pallet through the corners 58 of the respective inner closure flaps 30.

Although the primary novelty of the invention resides in the connection between the inner closure flap slots and the diagonally extending side panels, the container is provided with a separate lid L which may be of various designs.

In the present invention the lid L illustrated in FIGS. 6 and 7 may be formed from a unitary blank LB of paperboard illustrated in FIG. 8.

The lid includes an octagonal shaped top wall 50 provided with a plurality of vent holes 51. The top wall 50 has a plurality of of side flanges 52 foldably joined to and depending from opposite side edges thereof along fold lines 53 and a plurality of corner flanges 54 foldably joined to and depending from the top wall panel along its diagonally extending corners.

Each of the corner flanges 54 includes an outer panel 54*a*, foldably joined to the top panel along a fold line 55*a*, a bottom panel 54*b*, foldably joined to the outer panel 54*a* along a fold line 55*b*, and an inner panel 54*c*, foldably joined to the bottom panel 54*b* along a fold line 55*c*.

When the lid is erected the ends of the side flanges are sandwiched between the inner and outer panels of the corner flanges, as best seen in FIG. 7, and the end portions of the inner panels 54*c* are inserted into the slots 57 at the corners of top wall 50 to maintain the flanges in erected condition.

This, it will be appreciated that the invention provides a novel, octagonally shaped, collapsible container for heavy articles, with interlocking connections between certain of the bottom closure flaps and certain of the side panels to help the container maintain its original shape.

What is claimed is:

1. A collapsible, octagonal container formed from foldable paperboard, comprising:

(a) first, second, third, fourth, fifth, sixth, seventh, and eight side panels foldably joined to each other along parallel vertical fold lines to form a tubular structure open at the ends;

(b) said first and fifth side panels extending parallel to each other and normal to said third and seventh side panels, and said second, fourth, sixth, and eighth side panels extending diagonally between adjacent side panels;

(c) inner closure flaps foldably joined to lower edges of said third and seventh side panels and folded inboardly therefrom and normal thereto toward each other;

(d) said inner closure flaps each having:

(i) a width greater than that of the panel to which it is joined and having side portions extending outboardly beyond the panels adjacent the panel to which it is joined;

(ii) a pair of outer closure flap receiving slots extending part way thereinto from an inboard edge thereof and being parallel to and spaced from each other;

(iii) a pair of side panel receiving slots extending diagonally thereinto from side edges thereof and adapted to receive lower portions of related diagonally extending side panels to help the container maintain its octagonal shape;

(e) outer closure flaps foldably joined to lower edges of said first and fifth side panels and folded inboardly therefrom and normal thereto toward each other;

(f) lock flaps foldably joined to inboard edges of said outer closure flaps and folded upwardly therefrom and normal thereto and received within related outer closure flap receiving slots of said inner closure flaps.

2. A collapsible container according to claim 1, wherein each of said inner closure flaps has a width substantially equal to the combined widths if the panel to which it is joined and the adjacent side panels.

3. A collapsible container according to claim 1, wherein each of said inner closure flaps has end portions that extend outboardly beyond the side panels adjacent the panel to which the inner closure flap is joined.

4. A collapsible container according to claim 1, wherein each of said diagonally extending side panels has a projection extending downwardly from its lower edge for receipt within a related inner closure flap slot.

5. A container according to claim 1, wherein said outer closure flap lock flaps extend upwardly into said container above said inner closure flaps for engagement with an article packaged in the container to support and cushion the article.

6. A collapsible container formed from foldable paperboard, comprising:

(a) a first pair of opposed side panels;

(b) a second pair of opposed side panels extending parallel to each other and normal to the side panels of said first pair;

(c) a plurality of side panels disposed to extend diagonally with respect to the side panels of said first and second pairs;

(d) all of said side panels being foldably joined to each other along parallel fold lines to form a tubular structure open at the ends;

(e) inner closure flaps foldably joined to lower edges of the side panels of said first pair and folded inboardly therefrom and normal thereto toward each other;

(f) said inner closure flaps each having:

(i) a width greater than that of the panel to which it is joined and having side portions extending outboardly beyond the panels adjacent the panel to which it is joined;

(ii) a pair of outer closure flap receiving slots extending part way thereinto from an inboard edge thereof and being parallel to and spaced from each other;

(iii) a pair of side panel receiving slots extending diagonally thereinto from side edges thereof and adapted to receive lower portions of related diagonally extending side panels to help the container maintaine its original shape;

(g) outer closure flaps foldably joined to lower edges of the side panels of said second pair and folded inboardly therefrom and normal thereto toward each other;

(h) lock flaps foldably joined to inboard edges of said outer closure flaps and folded upwardly therefrom and normal thereto and received within related outer closure flap receiving slots of said inner closure flaps.

7. A collapsible container according to claim 6, wherein each of said inner closure flaps has a width substantially equal to the combined widths if the panel to which it is joined and the adjacent side panels.

8. A collapsible container according to claim 6, wherein each of said inner closure flaps has end portions that extend outboardly beyond the side panels adjacent the panel to which the inner closure flap is joined.

9. A collapsible container according to claim 6, wherein each of said diagonally extending side panels has a projection extending downwardly from its lower edge for receipt within a related inner closure flap slot.

10. A container according to claim 6, wherein said outer closure flap lock flaps extend upwardly into said container above said inner closure flaps for engagement with an article packaged in the container to support and cushion the article.

11. A blank of foldable paperboard for use in making a collapsible, octagonal container, said blank being cut and scored to provide:

(a) first, second, third, fourth, fifth, sixth, seventh, and eighth side panels foldably joined to each other along parallel fold lines;

(b) inner closure flaps foldably joined to corresponding edges of said third and seventh side panels and each having;

(i) a width substantially equal to the combined widths of the panel to which it is joined and the panels adjacent the panel to which it is joined;

(ii) a pair of outer closure flap receiving slots extending part way thereinto from an outer edge thereof and being parallel to and spaced from each other;

(iii) a pair of side panel projection receiving slots extending diagonally thereinto from side edges thereof;

(c) outer closure flaps foldably joined to corresponding edges of said first and fifth side panels;

(d) lock flaps foldably joined to outer edges of respective outer closure flaps.

12. A collapsible container blank according to claim 11, wherein each of said second, fourth, sixth, and eighth side panels has a projection extending downwardly from an edge thereof adjacent a related inner closure flap for receipt within a related inner closure flap slot when the container is erected.

* * * * *